United States Patent [19]

Jasinski

[11] Patent Number: 4,592,536

[45] Date of Patent: Jun. 3, 1986

[54] APPARATUS FOR DISTRIBUTING A STACK OF ROOF PANELS ATOP A ROOF

[76] Inventor: Donald W. Jasinski, 3380 B. Mack Rd., Saginaw, Mich. 48601-7109

[21] Appl. No.: 515,395

[22] Filed: Jul. 20, 1983

[51] Int. Cl.[4] ..... B60P 1/48

[52] U.S. Cl. ..... 254/8 R; 254/17; 104/247

[58] Field of Search ..... 254/8 R, 8 B, 8 C, 17, 254/120; 104/118, 119, 162, 245, 247; 414/495; 280/43, 17; 238/10 R

[56] References Cited

U.S. PATENT DOCUMENTS

| | | | |
|---|---|---|---|
| 342,816 | 6/1886 | Thaxter | 254/8 C |
| 1,373,754 | 4/1921 | Miller | 104/247 |

FOREIGN PATENT DOCUMENTS

| | | | |
|---|---|---|---|
| 239828 | 8/1963 | Austria | 414/495 |
| 898950 | 3/1953 | Fed. Rep. of Germany | 254/8 B |

*Primary Examiner*—Frederick R. Schmidt
*Assistant Examiner*—Judy J. Hartman
*Attorney, Agent, or Firm*—John J. Swartz

[57] ABSTRACT

Apparatus for moving a load, particularly a stack of panels, along a roof structure, including a plurality of spaced-apart roof rafters and transverse purlins comprising: a roof-mounted rail for mounting on said roof in vertical alignment with a purlin, a load-carrying cart comprising a carriage having rollers movable along the rail, and a load-carrying platform mounted on the carriage for longitudinal and vertical movement relative thereto including an inverted U-shaped elongate channel member. Mechanism is provided for relatively longitudinally moving the load-carrying platform and the carriage between rest positions and longitudinally displaced positions. The carriage and load-carrying platform include cooperating camming rollers and cam receiving slots which upwardly guide the platform relative to the carriage as the carriage and platform are relatively longitudinally moved, to lift the load relative to the roof structure for subsequent rolling movement via the carriage on the track. One aspect of the invention includes an inverted U-shaped load support platform which spans the track and the cart and underlies the load to support the load when the load-carrying platform is in the rest position but is moveable upwardly with the load when the platform is moved to the raised level. Another aspect of the present invention includes a stop bar plate on the rail, engageable by the cart after the cart and rail have relatively moved a predetermined distance. When the load-carrying platform is at the lowered level and the operator continues to bodily move the cart, the rail is longitudinally moved with the cart, to provide a track which has an effective length much greater than its actual length.

15 Claims, 4 Drawing Figures

APPARATUS FOR DISTRIBUTING A STACK OF ROOF PANELS ATOP A ROOF

BACKGROUND OF THE INVENTION

1. Field of the Invention

This invention relates to apparatus for distributing a stack of roof panels atop a building roof structure, either during initial construction or while existing roof panels are being replaced, and more particularly to a new and novel self-loading "low height" cart which will lift a relatively heavy, roof-mounted stack of panels to an elevated position relative to the underlying roof structure, transport the stack along a rail secured atop the roof to any selected one of a plurality of different positions on the roof, and then lower the stack at an adjusted position on the roof.

2. Description of the Prior Art and Objects of the Invention

Steel buildings are conventionally constructed with a "red iron" frame having a roof structure which includes an underlying matrice comprising a plurality of generally parallel, spaced-apart relatively heavy roof rafters and a plurality of relatively lightweight, transversely extending, panel support stringers or purlins. The rafters of a typical steel building may be 24 to 30 feet apart, whereas the transversely extending purlins, which are substantially lighter than the relatively heavy rafters, may typically be spaced at five foot intervals. Conventionally, the rafters are covered with steel roof panels which are initially delivered to the roof in a stacked bundle. Lifting cranes have sometimes been employed heretofore for supplying the stacked bundle to the roof structure and then distributing the individual panels about the roof area.

Steel roof panels are typically provided in banded bundles which the workers sometimes previously "rolled" over the roof purlins onto the portion of the roof panels which they had just laid. To accomplish this, the workers heretofore walked on the underlying purlins. This maneuver is relatively dangerous, difficult and time-consuming, and interferes with the laying of the roof panels.

A prior art roof panel distributing cart, sold under the trademark "Magic Roofer", has been provided heretofore but is relatively complicated and includes clamps and rollers which must be assembled on the roof. With the prior art "Magic Roofer" cart, the roof panels were loaded on the end of the roof, opposite the start end, and then moved the entire length of the roof.

Accordingly, it is an object of the present invention to provide new and novel apparatus for moving bundles of roof panels atop the roof panels which were just laid without damaging the previously laid roof panels.

It is another object of the present invention to provide new and novel apparatus for distributing roof panels atop a roof by the bundle via a portable cart and a portable track on which the cart rides.

It is another object of the present invention to provide new and novel bundle moving apparatus which will minimize the manpower required to distribute roof panels on a roof.

It is another object of the present invention to provide apparatus for distributing roof panels, by the bundle, on a roof, either while the building is being built or during a roof re-covering operation, which apparatus will raise the relatively heavy bundles a short distance relative to the roof frame and, then, by means of rollers provided thereon, transport the bundles atop a rail, which is mounted atop the roof structure.

The apparatus constructed according to the present invention contemplates a carriage including an inner, downwardly opening, inverted U-shaped, elongate channel member mounting rollers for rollingly engaging a roof-supported track member, a load-carrying platform mounted on the carriage for longitudinal and vertical movement relative thereto, including an outer, downwardly opening inverted U-shaped, elongate channel which mounts guide rollers that are received in guide slots for upwardly urging the platform to elevate the roof-supported stack of panels as the platform and the carriage are relatively longitudinally moved via a pivotally mounted handle.

Accordingly, it is another object of the present invention to provide new and novel cart apparatus of the type described, including cooperating slots on one of the carriage and the load-carrying platform and laterally extending roller pins mounted on the other of the carriage and the platform and received by the slots for guiding the relative vertical paths of travel of the platform and the underlying carriage as the platform and underlying carriage are relatively longitudinally moved.

The present invention contemplates an elongate handle pivotally mounted on one of the carriage and the load-carrying platform and a coupling member coupled between the handle and the other of the carriage and load-carrying platform to relatively longitudinally move the load-carrying platform and the carriage for upwardly camming the platform to lift the load relative to the underlying roof structure. Once the load has been lifted, the handle will substantially unassistedly remain in the load-lifting position, without the necessity of a lock.

The apparatus constructed according to the present invention further contemplates a bundle support frame which is mounted on the roof and includes a generally inverted U-shaped support member which overlies the track and underlies and supports the stack of roof panels a sufficient distance to permit the track-mounted cart to pass thereunder. The inverted U-shaped support will be elevated and carried by the cart as the stack is moved and, thus, the support platform will remain in a position underlying the stack, as the stack is lowered in the reset position. Accordingly, the user can move the stack along the length of the underlying rail and reset it in an adjusted position, without the necessity of having additional workers move the underlying stack support platform.

The present invention further contemplates the use of an upstanding bracket or stop, mounted on a "stop-end" of the roof-mounted track, having a portion thereof in the path of the cart such that, when the cart reaches the "stop end" of the track, the user can set the bundle and the underlying U-shaped bundle support on the roof and then continue bodily movement of the entire cart relative to the bundle and support. As the cart continues to be bodily moved relative to the bundle and support, it engages the upstanding track-supported bracket, whereby the underlying track will be carried thereby to the next longitudinally adjusted position in which the end opposite the "stop end" is drawn to a position underlying the stack. The user will then merely return the cart, in an opposite direction, on the repositioned track to a position underlying the inverted U-shaped stack support member and stack and will operate the cart handle to lift the platform relative to the carriage and again raise the stack so that it can be moved along the length of the repositioned underlying track. By repeating this operation, the relatively short rail is repositioned along the entire length of the roof to provide a continuous effective length which is much greater than its actual length.

Accordingly, it is an object of the present invention to provide new and novel cart-loading and moving apparatus of the type described, including an underlying track, which is substantially shorter than the length of the roof, and cooperating mechanism on the track and cart for repositioning the track to provide a continuous track the entire length of the roof.

Various low height trolleys have been provided heretofore for handling heavy articles such as that disclosed in U.S. Pat. No. 2,546,539 issued to M. H. Fehn on Mar. 27, 1951; U.S. Pat. No. 2,638,354 issued to H. J. Larson, et al on May 12, 1953; U.S. Pat. No. 2,981,350 issued to R. L. Zouck, et al on April 25, 1961; and U.S. Pat. No. 3,091,477 issued to G. B. Johnstone on May 28, 1963. None of these patentees disclose applicant's construction and do not even appreciate the problems which applicant has solved.

Other objects and advantages of the present invention will become apparent to those of ordinary skill in the art as the description thereof proceeds.

SUMMARY OF THE INVENTION

Apparatus for distributing bundles of panels, such as steel roof panels, atop a building roof structure, comprising: At least one guide rail for mounting on the roof structure; at least one panel support cart comprising an inner, downwardly opening, channel member including a base and a pair of downwardly extending legs; an outer downwardly opening, inverted U-shaped channel member, juxtaposed above the inner channel member, including a base and a pair of downwardly extending legs depending therefrom; the legs of the inner channel member including upwardly inclined slots; transversely extending pins, mounted on the legs of the outer channel member and received by the inclined slots; a plurality of track-engaging rollers mounted on the legs of the inner channel member; and mechanism for relatively longitudinally moving the inner and outer channel members, whereby the pins are guided upwardly by the slots to raise the upper U-shaped channel member to an elevated bundle-elevating position relative to the inner channel member.

BRIEF DESCRIPTION OF THE DRAWINGS

The invention may be more readily understood by referring to the accompanying drawings, in which.

DESCRIPTION OF THE PREFERRED EMBODIMENT

Figure 4:
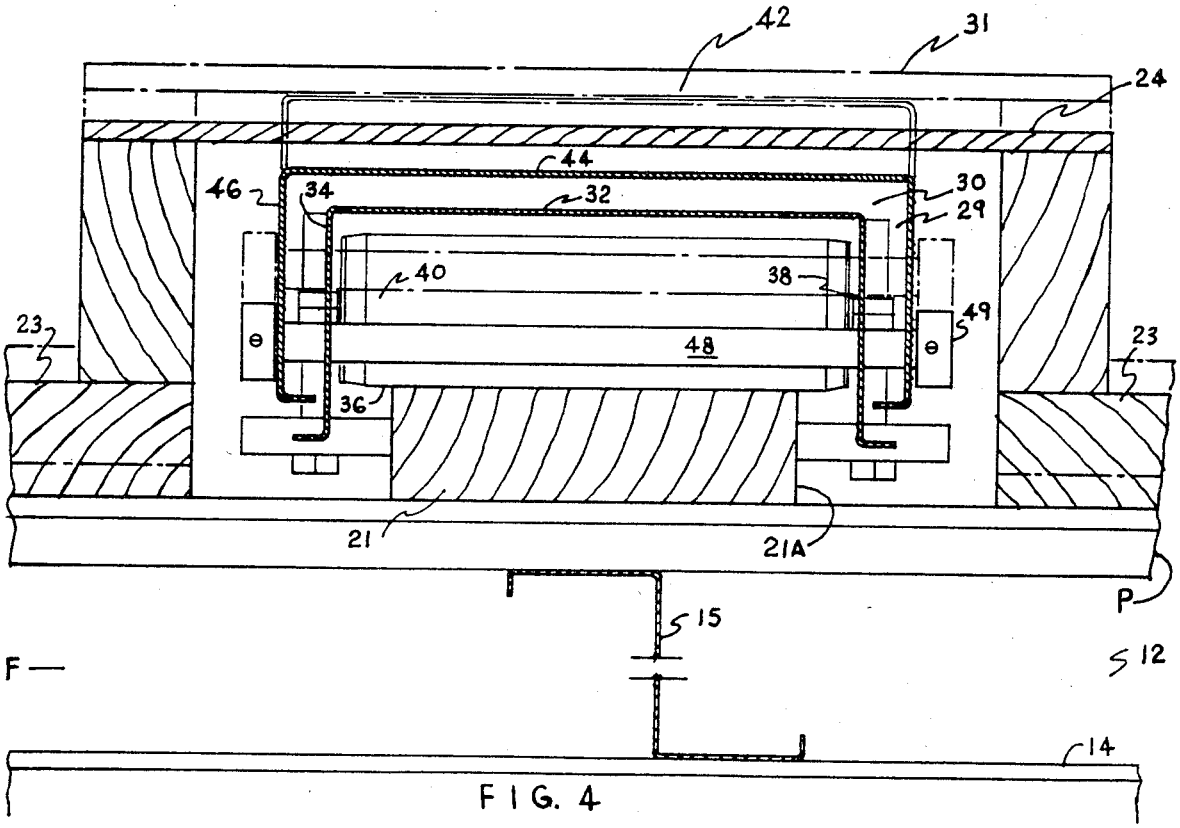
FIG. 4 is a further enlarged sectional end view, taken along the line 4—4 of FIG. 3.

Apparatus constructed according to the present invention, generally designated 10, is particularly adapted for use in moving a bundle or stack, schematically illustrated at S, of individual roof panels P atop a roof structure, generally designated 12, including a plurality of generally parallel, spaced-apart, relatively heavy steel roof rafters 14, mounting a plurality of transverse, overlying, spaced-apart, relatively lightweight steel purlins 15. The steel rafters 14 and purlins 15 form the upper portion of a lattice frame F, commonly referred to as a "red-iron" frame. A layer of heating insulation is laid between the rafters 14, as usual. Mounted atop the roof purlins 15, as illustrated in FIG. 4, is a plurality of installed roof panels P extending from the ridge to the eve of the roof. Each panel P typically includes a recessed, longitudinally extending center portion 18 (FIG. 1) and upstanding, longitudinally extending side interlock sections 20 which interlock with the adjacent complementally formed interlock portions 20 of the adjacent panels P.

The apparatus 10 constructed according to the present invention includes a pair of spaced-apart rails or tracks, generally designated 21, extending transversely of the upstanding panel interlock portions 20. The rails or tracks 21 may each suitably comprise a 2"×6" wood rail mounted in vertical alignment with an underlying purlin 15. As illustrated, the length of each rail 21 is substantially less than the length of the roof.

The apparatus 10 includes a pair of roof-mounted stack support stands, generally designated 22, each including a pair of laterally spaced-apart, L-shaped, elongate side frame members 23 mounted on laterally opposite sides of rail 21, spanned by a stack support plate 24 which supports the stack S of roof panels P in vertically-spaced relation with the underlying roof structure 12.

Apparatus is provided for lifting the stack support stands 22 and the stack S of panels P supported thereby and moving same along the track or rail 21 in the direction of the arrow 26, and includes a pair of carts, generally designated 28. Each cart 28 includes a rail-mounted carriage, generally designated 29, and a vertically juxtaposed load-carrying platform, generally designated 31, which is mounted on the carriage 29 for longitudinal and vertical movement relative thereto. Each carriage 29 includes an inverted, elongate, U-shaped channel member, generally designated 30, having an elongate base member 32 and a pair of elongate legs 34 depending therefrom at opposite sides of the rail or track 21. The carriage 29 includes a plurality of track-engaging rollers 36 each journaled, via bearings 38, on a transversely extending shaft 40 which spans the depending channel legs 34.

Each overlying load-carrying platform 31 comprises another downwardly opening, inverted, U-shaped elongate channel member, generally designated 42, including a base member 44, generally overlying base member 32, and a pair of laterally spaced-apart, elongate legs 46 depending therefrom laterally outwardly of the legs 34. The platform 31 is supported on the carriage 29 via a plurality of roller bars 48 which are journaled in bearing blocks 49 mounted on the outer channel legs 46. The roller bars 48 are received in vertically rearwardly, upwardly inclined guide slots 50 provided along the length of the inner dependent legs 34.

Apparatus, generally designated 52, is provided for longitudinally relatively moving each load-carrying platform 31 relative to the carriage 29 and includes a generally upstanding handle member 54 having a transversly extending hollow tube 56 journaled on an internal shaft 58 which spans a pair of side channel frame members 60 fixed to the inner channel legs 34. The internal shaft 58 is detachably mounted to the frame members 60 via pins 61.

A pair of coupling straps 62 are pivotally connected to the handle 54, via a pivot pin 64, and to the load-carrying platform 31, via a pivot pin 66, which is mounted on a plate 68 extending rearwardly from the upper channel base member 44.

Figure 2:
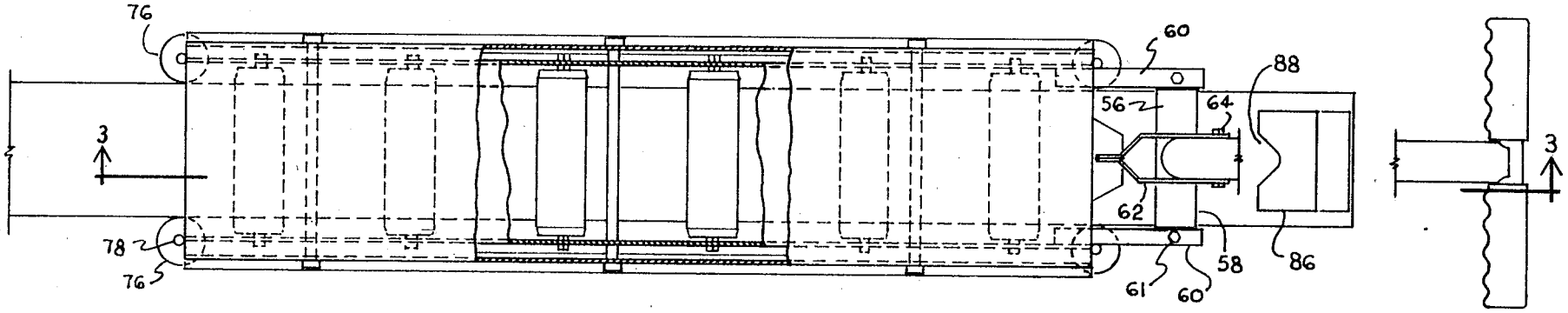
FIG. 2 is an enlarged top plan view, turned end-for-end, of one of the carts illustrated in FIG. 1, part of the cart being broken away to more particularly illustrate the underlying track, rollers and mounting structure.
Figure 3:
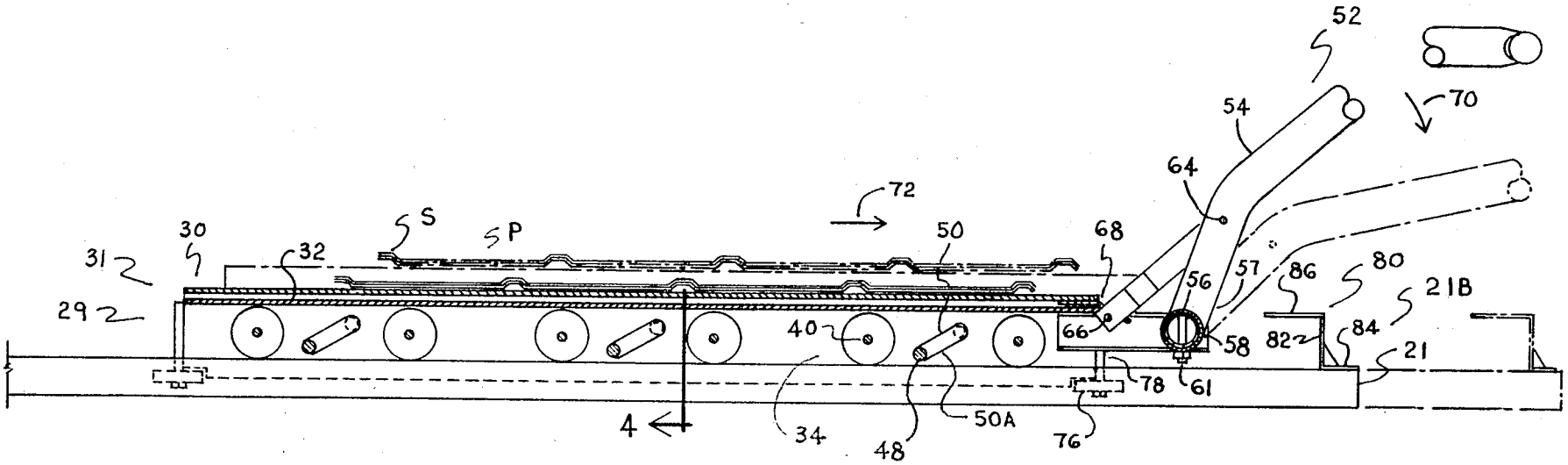
FIG. 3 is a sectional side view thereof, taken along the line 3—3 of FIG. 2.

As the handle 52 is moved clockwisely, in the direction of the arrow 70 (FIG. 3), from the position illustrated in solid lines in FIG. 3 to the position illustrated in chain lines in FIG. 3, the upper load-carrying platform 31 will move rearwardly, in the direction of the arrow 72 relative to the underlying carriage 29. As the load-carrying platform 31 moves rearwardly, the guide rollers 48 will ride in slots 50, to be cammed upwardly from the position illustrated in solid lines in FIG. 3 to the position illustrated in chain lines in FIG. 2, to an elevated position in which the platform 22 and the stack S has been raised to a level spaced from the roof structure 12. Due to the relationship of the parts, the platform 22 will substantially unassistedly remain in the elevated position without any substantial downward force being exerted on handle 54. The operator then need only pull on the handle, in the direction of the arrow 26, to move the cart 28, the stack support stand 22, and the stack S along the track 21.

When the stack S has been longitudinally moved to any selected suitable position on the rail 21, the handle 52 is swingably returned from the position illustrated in chain lines to the position illustrated in solid lines in FIGS. 3 and 4, and the entire load platform 22 and stack S is returned to the position illustrated in solid lines in FIGS. 3 and 4, supported by the roof structure 12.

A plurality of side "corner" rollers 76 are rotatably mounted on vertical spindles 78 which are fixed to the inner channel member 30. The axes of the spindles 78 are normal to the axes of the shafts 40. The side rollers 76 bear against the side surfaces 21*a* of the track 21 to inhibit lateral movement of the cart 28 relative to the track 22 when the apparatus is used on a roof having a pitch up to and including 4/12.

The carts 28 will thus carry both the load platform 22 and the panel stacks to eliminate the necessity of additional workers separately repositioning the load platform 22 when the stack S is repositioned.

As the roof continues to be installed, the stack S is sequentially repositioned along the length of rail 21. As the cart 28 approaches the "stop" end 23 of the track 21, the operator could lay another track in end-to-end relation with the track 21, but this would necessitate yet additional "track" material being lifted onto the roof structure.

The apparatus constructed according to the present invention includes an upstanding Z-shaped bracket or plate, generally designated 80, fixed to the "stop" end 23 of rail 21. The Z-shaped bracket 80 includes a central upstanding plate portion 82 having an offset lower end 84 fixed to the end 23 of the track 21, and an upper, oppositely offset plate portion 86. The upper offset plate portion 86 includes a central notch 88 which receives the lower end 57 of the handle 54 when the cart 28 is longitudinally moved into engagement with the Z-shaped plate member 80. The handle 52 is maintained in the upright position, and the entire cart 28 is then bodily carried by the worker to drag the track 21 in the direction of the arrow 72 relative to the roof-supported stack S. When the track 21 has again been repositioned such that the end opposite stop end 23 underlies the stack, the user will return the cart 28 on the repositioned track to the position illustrated in FIG. 3, again underlying the support stand 22 and the stack S.

THE OPERATION

Figure 1:
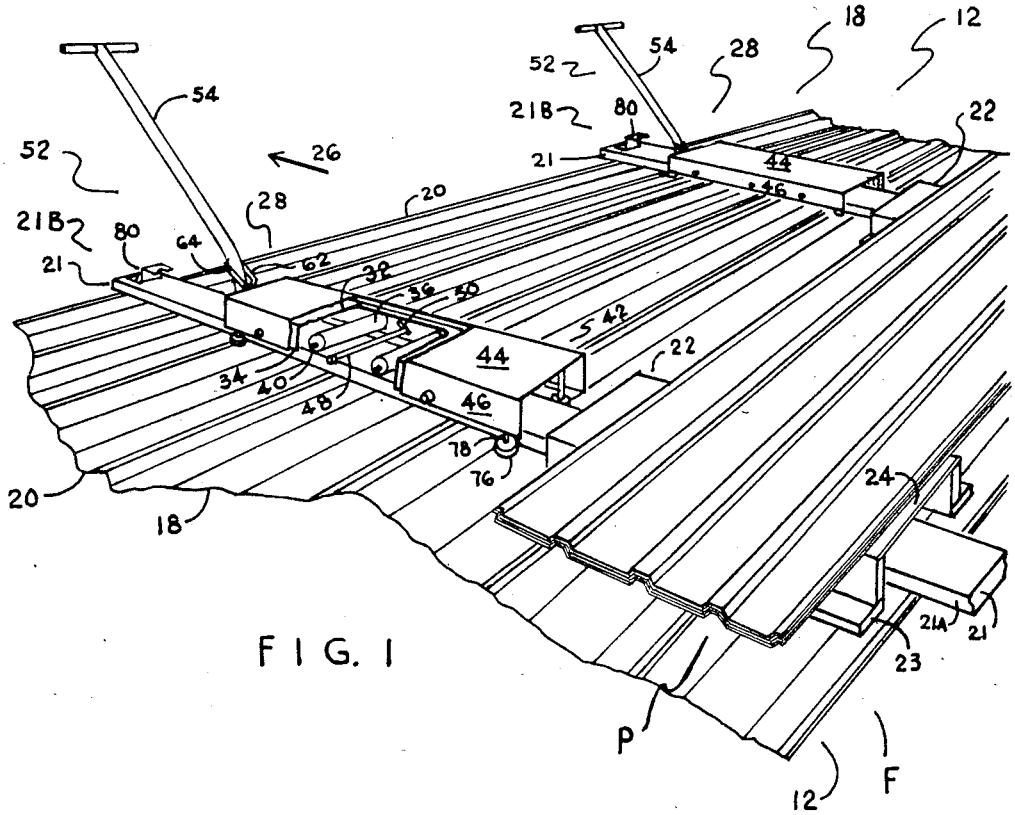
FIG. 1 is a perspective view illustrating apparatus constructed according to the present invention mounted atop a roof structure.

A pair of rails 21 are mounted atop the roof 12 in laterally spaced relation. A pair of stack support members 22 are disposed on the roof so as to straddle the rails 21. A stack S of panels P is placed on the stack support members 22, as illustrated in FIG. 1. With the handles 52 in the position illustrated in solid lines in FIG. 3, the operator moves the carts 28 to positions underlying the stack support members 22.

The cart handles 54 are then moved downwardly, in the direction of the arrow 70, to the positions illustrated in chain lines in FIG. 3. As this occurs, the load-carrying platforms 31 will move longitudinally relative to the carriage 29 and will concurrently be cammed upwardly via the roller bars 48 which are received in the upwardly inclined guide slots 50. The stack support members 22 and stack S will thus be moved upwardly to the position illustrated in chain lines in FIG. 4, in spaced relation with the roof. The load will be supported via the track-engaging rollers 36 which bear against the rails 21. The operator will then draw the handles 54 in the direction of the arrow 26 to move the stack S and supports 22 to a longitudinally displaced position. When the stack S has been moved a sufficient distance, the user will then move the handles 54 in the opposite direction, whereby the load-carrying platforms 31 will move in the longitudinally opposite direction and will concurrently lower to reset the stack support members 22 on the roof in a reset position.

This operation can be repeated until such time as the end of the rail 21 is reached. The operator need then merely only, while the handle 54 is in the upright position illustrated in solid lines in FIG. 4, bodily move the entire carriage longitudinally so that the lower end 57 of handle 54 will engage the Z-shaped bracket 80. As the user continues to bodily move the cart, the track 21 will be carried thereby to a position in which the upstream end, opposite the stop end, is again positioned as illustrated in FIG. 1 underlying the stack S.

The operation can then be repeated.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Apparatus for hauling a stacked bundle of roof panels atop a building roof structure having a plurality of generally parallel, spaced-apart rafters, said apparatus comprising:

track means for mounting on a roof structure;

at least one panel support cart, comprising: carriage means including an inner, downwardly opening, inverted U-shaped elongate channel member including a first base member overlying said track means and a first pair of laterally spaced-apart, longitudinally extending legs depending therefrom;

roller means mounted on said inner channel for rollingly engaging said track means; and load carrying platform means mounted on said carriage means for longitudinal and vertical movement relative thereto, including an outer, downwardly opening inverted U-shaped elongate channel member including a second base member overlying said first base member and a second pair of laterally spaced-apart, longitudinally extending legs depending therefrom laterally outwardly of said first pair of legs;

means coupled to and reacting between said carriage means and said load-carrying platform means for relatively longitudinally moving said carriage means and said load carrying platform means between rest positions and longitudinally displaced positions; and means reacting between and responsive to relative longitudinal movement of said carriage means and said load-carrying platform means for vertically guiding said load-carrying platform means between lowered and raised levels as said carriage means and said load-carrying platform means are relatively moved between said rest and longitudinally displaced positions, to lift a stacked bundle of panels, comprising;

vertically upwardly inclined slots in said first pair of legs and laterally extending cylindrical roller means spanning said second pair of legs and received by said upwardly inclined slots in said first pair of legs; and means for moving said track means relative to said stacked bundle of roof panels as said cart continues to by bodily longitudinally moved after a predetermined relative longitudinal movement of said cart and said track means and said platfrom means and said carriage means are in said rest positions including means mounted on a downstream portion of said track means in the path of said cart to contact said cart such that further longitudinal movement of said carriage means forces movement of said track means.

2. The apparatus set forth in claim 1 wherein said means mounted on said track means comprises a Z-shaped plate.

3. The apparatus set forth in claim 1 wherein said means mounted on said track means comprises an upstanding plate having an offset terminal end projecting toward said carriage at a level above said track means.

4. The apparatus set forth in claim 1 wherein said cart includes further roller means rotatable about an axis normal to the rotational axis of said first mentioned roller means, for rollingly engaging the lateral surfaces of said track means to preclude lateral shifting of said cart when said cart is mounted on an inclined roof.

5. The apparatus set forth in claim 4 wherein said rollers are rotatably mounted on said cart about vertical axes for rollingly engaging laterally opposite sides of said track.

6. The apparatus set forth in claim 1 wherein said means for relatively longitudinally moving said carriage means and said platform means comprises an elongate upstanding handle pivotally mounted on one of said carriage means and said platform means, and further including coupling means pivotally coupled to said handle means and the other said carriage means and platform means.

7. The apparatus set forth in claim 1 further including portable support means, removably mountable on a roof, for supporting a bundle when said platform means and said carriage means are in said rest positions, comprising a pair of upstanding, longitudinally extending, laterally spaced rails on laterally opposite sides of said platform means, and plate means spanning and fixed to said rails, at a level such that said platform means, in said lowered position, is at a level below said plate means but said plate means will be carried by said platform means when said platform means at said elevated level.

8. The apparatus set forth in claim 7 wherein each of said side rails comprises an elongate L-shaped rail member.

9. Apparatus for hauling a stacked bundle of roof panels atop a building roof structure having a plurality of generally parallel, spaced-apart rafters, said apparatus comprising:

track means for mounting on a roof structure;

at least one panel support cart, comprising: carriage means including an inner, downwardly opening, inverted U-shaped elongate channel member including a first base member and a first pair of laterally spaced-apart, longitudinally extending legs depending therefrom;

roller means mounted on said inner channel for rollingly engaging said track means; and load carrying platform means mounted on said carriage means for longitudinal and vertical movement relative thereto, including an outer, downwardly opening inverted U-shaped elongate channel member including a second base member overlying said first base member and a second pair of laterally spaced-apart, longitudinally extending legs depending therefrom laterally outwardly of said first pair of legs;

means coupled to and reacting between said carriage means and said load-carrying platform means for relatively longitudinally moving said carriage means and said load carrying platform means between rest positions and longitudinally displaced positions;

means reacting between and responsive to relative longitudinal movement of said carriage means and said load-carrying platform means for vertically guiding said load-carrying platform means between lowered and raised levels as said carriage means and said load-carrying means are relatively moved between said rest and longitudinally displaced positions, to lift a stacked bundle of panels, comprising;

vertically inclined slot means in one of said first and second pair of legs and laterally extending pin means on the other of said first and second pair of legs received by said slot means;

support means, mountable on said roof, for supporting a stacked bundle of roof panels when said platform means and carriage means are in said rest positions, comprising a pair of upstanding, longitudinally extending, laterally spaced rails on laterally opposite sides of said platform means, and plate means spanning said rails, at a level such that said platform means, in said lowered position, is at a level below said plate means but said plate means will be carried by said platform means when said platform means is at said raised level; and means for longitudinally moving said track means with said cart as said cart continues to be bodily longitudinally moved and said platform means and said carriage means are in said rest positions including means mounted on a downstream portion of said track means in the path of said cart to contact a portion of said cart such that said track means is moved as the cart is moved.

10. The apparatus set forth in claim 9 wherein said means mounted on said track includes an upstanding plate having an offset terminal end.

11. The apparatus set forth in claim 9 wherein said means for relatively moving said carriage means and said platform means comprises upstanding handle means, and said offset terminal end includes a central notch for receiving a portion of said handle means.

12. The apparatus set forth in claim 9 wherein said stop means comprises a stop member, mounted at one end of said track, having an upper offset terminal portion disposed in the path of said cart.

13. The apparatus set forth in claim 12 wherein said means for relatively longitudinally moving said carriage means and said platform means comprises upstanding handle means pivotally coupled to said carriage means and to said platform means; said offset terminal portion including a notch for receiving said handle means.

14. The apparatus set forth in claim 13 wherein said stop means comprises a Z-shaped plate having a lower oppositely extending offset end portion coupled to said track.

15. Apparatus for supporting and moving a load, such as a stack of roof panels, on a surface, such as a building roof, having a plurality of spaced-apart, generally parallel roof rafters, said apparatus comprising:

a longitudinally extending track for lying on said surface;

inverted U-shaped load support means for supporting said load at a level above said surface comprising laterally spaced-apart rails on laterally opposite sides of said track, and plate means, vertically spaced from said track, spanning said rails;

a cart for lifting said load and said load support means, including:

carriage means provided with roller means for rolling on said track;

load-carrying platform means mounted on said carriage means for longitudinal and vertical movement relative thereto between a lowered, rest position and an elevated, longitudinally spaced position;

means for moving said platform means between said rest position and said longitudinally spaced position, including handle means coupled to said carriage means and said load-carrying means for relatively longitudinally moving said load-carrying means and said carriage means; and means reacting between said carriage means and said platform means for moving said platform means between a lowered level and a higher level as said carriage means and said load-carrying means relatively longitudinally move to upwardly move said load support means and the load supported thereby; and stop means on said track for longitudinally moving said track with as said cart continues to be longitudinally moved in a direction toward said stop and said platform means is in said rest position including means mounted on a downstream portion of one of said track and said cart engageable with said cart to contact a portion of carriage means and said such that a predetermined relative longitudinal movement of said cart forces movement of said track.

* * * * *